US006612444B2

(12) United States Patent
Craddock et al.

(10) Patent No.: US 6,612,444 B2
(45) Date of Patent: Sep. 2, 2003

(54) APPARATUS AND PROCESS FOR RECOVERING A DESIRED FRACTION OF A RAW MATERIAL

(75) Inventors: Mark Norman Paul Craddock, Gauteng (ZA); Michael Roy Kilner, Gauteng (ZA); Warren Wentworth Dale, Gauteng (ZA)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/801,904

(22) Filed: Mar. 9, 2001

(65) Prior Publication Data

US 2002/0000412 A1 Jan. 3, 2002

(51) Int. Cl.[7] ..... B03D 1/14; B03D 1/24; B02C 23/30; B02C 23/36

(52) U.S. Cl. ..... 209/164; 209/168; 209/169; 209/170; 241/24.1; 241/79.1

(58) Field of Search ..... 209/164, 168, 209/170, 169; 241/24.1, 79.1

(56) References Cited

U.S. PATENT DOCUMENTS 2,938,629 A * 5/1960 Hollingsworth et al.
3,446,353 A * 5/1969 Davis
3,542,298 A * 11/1970 Kiesskalt
4,109,874 A * 8/1978 Stoev et al.
4,324,652 A * 4/1982 Hack
4,964,576 A * 10/1990 Datta
5,066,388 A * 11/1991 Ross
5,337,965 A * 8/1994 Chiovitti
5,346,532 A * 9/1994 Sinclair et al.
5,392,924 A * 2/1995 Hume
6,082,549 A * 7/2000 Gommel et al.

FOREIGN PATENT DOCUMENTS

| | | |
|---|---|---|
| EP | 0 469 195 | 2/1992 |
| EP | 0 574 175 | 12/1993 |
| EP | 0 894 891 | 2/1999 |

* cited by examiner

*Primary Examiner*—Thomas M. Lithgow
(74) *Attorney, Agent, or Firm*—Baker & Hostetler LLP

(57) ABSTRACT

An apparatus for recovering a desired fraction of a raw material bearing the desired fraction has a vessel or cell defining a treatment chamber therein, with an inlet into the chamber for introducing a slurry of raw material to be treated into the chamber. An attrition zone is defined in a portion of the chamber proximate the inlet in the flow path of material introduced into the chamber, the particles being caused to impact against each other in the attrition zone to cause attritioning thereof. A floatation zone is defined in a distal portion of the chamber, in flow communication with the attrition zone, in which attritioned particles from the attrition zone can be contacted with gas bubbles to form a froth phase separated from the slurry by a slurry-froth interface such that the desired fraction is either selectively taken up into the froth phase by the gas bubbles or selectively left behind in the slurry. An outlet from the chamber for the froth phase is present.

5 Claims, 3 Drawing Sheets

APPARATUS AND PROCESS FOR RECOVERING A DESIRED FRACTION OF A RAW MATERIAL

BACKGROUND OF THE INVENTION

THIS invention relates to an apparatus and process for recovering a desired fraction of a raw material bearing the desired fraction.

A desired fraction from value bearing raw materials, such as rock, coal or the like is commonly recovered in a froth flotation method. In such a method, the raw material is typically ground into a finely particulate form which is then contacted with water and suitable flotation agents to form a slurry. The slurry is then contacted with finely dispersed gas bubbles rising through the slurry in such a way that the desired fraction is either selectively attached to the bubbles or is selectively left behind in the slurry. The appropriate phase be it the froth phase or the slurry, will then have a higher concentration of the desired fraction and may be separated for further processing.

A problem associated with conventional froth flotation methods is that the particulate material is not always in a form suitable for froth flotation. For instance, the surface of the particles may be covered with gangue material, be coated with an oxidised film or the like. As a result, the chemicals that are added to the slurry to impart hydrophobic tendencies to the particles to be floated are not able to operate optimally or at all.

SUMMARY OF THE INVENTION

According to a first aspect of the invention there is provided an apparatus for recovering a desired fraction of a raw material bearing the desired fraction, the apparatus comprising:

a vessel or cell defining a treatment chamber therein;

an inlet into the chamber for introducing a slurry of raw material to be treated into the chamber;

an attrition zone defined in a portion of the chamber proximate the inlet in the flow path of material introduced into the chamber, the particles being caused to impact against each other in the attrition zone to cause attritioning thereof;

a flotation zone defined in a distal portion of the chamber, in flow communication with the attrition zone, in which attritioned particles from the attrition zone can be contacted with gas bubbles to form a froth phase separated from the slurry by a slurry-froth interface such that the desired fraction is either selectively taken up into the froth phase by the gas bubbles or selectively left behind in the slurry; and an outlet from the chamber for the froth phase.

The inlet preferably comprises multiple nozzles extending radially into the chamber and towards one another, the nozzles being arranged to introduce the slurry into the attrition zone in such a manner that the particles emanating from the different nozzles contact one another under high velocity.

Alternatively, or additionally, the attrition zone may have an associated attritioning means for causing the particles to contact one another under high velocity.

The attritioning means may, for instance, be in the form of a pair of spaced apart impellers defining the attrition zone between them, the impellers being arranged to force particles to collide with one another in the attrition zone.

The apparatus may include a screen or similar size selective component located intermediate the attrition zone and the flotation zone for selectively allowing attritioned particles to pass into the flotation zone.

The apparatus typically includes a bypass system for particles which have not been taken up into the froth phase to return to the attrition zone for a further pass.

The attrition zone is preferably located in a lower portion of the vessel and the flotation zone in an upper portion of the vessel.

The invention extends to a process for recovering a desired fraction from a raw material bearing the fraction, the process including the steps of:

(a) grinding the raw material into particles and contacting the particles with water to form a slurry;

(b) attritioning the particles by passing the slurry through an attrition zone in a suitable apparatus;

(c) contacting the attritioned particles with gas bubbles and suitable flotation agents in the same apparatus as in step (b) to form a froth phase separated from the slurry by a slurry-froth interface such that the desired fraction is either selectively taken up into the froth phase or selectively left behind in the slurry; and (d) recovering the desired fraction from the froth phase or the slurry, as the case may be.

Embodiments of the invention are described in detail in the following passages of the specification which refer to the accompanying drawings. The drawings, however, are merely illustrative of how the invention might be put into effect, so that the specific form and arrangement of the features shown is not to be understood as limiting on the invention.

BRIEF DESCRIPTION OF THE ACCOMPANYING DRAWINGS

The invention will now be described in more detail, by way of example only, with reference to the accompanying drawings in which.

DETAILED DESCRIPTION OF PREFERRED EMBODIMENTS

Figure 1:
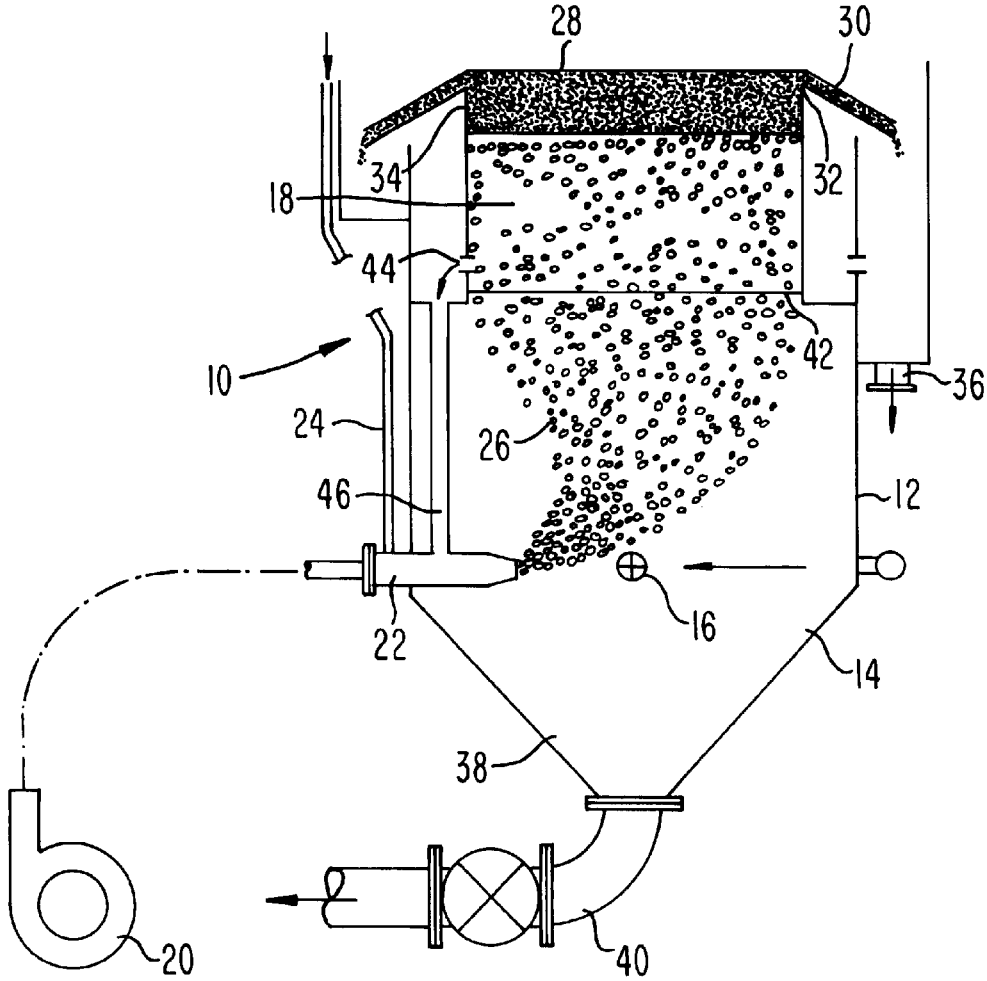
FIG. 1 is a schematic, sectional side view of a first embodiment of an apparatus of the invention.

Referring to FIG. 1 of the drawings, there is shown a first embodiment of the invention. The apparatus 10 for recovering a desired fraction of a raw material bearing the desired fraction consists of a vessel or cell 12 defining a treatment chamber 14. The treatment chamber 14 includes a lower attrition zone defined generally at 16 and an upper flotation zone defined generally at 18.

A recirculating pump 20 is arranged to pump a slurry of the raw material in the form of particulate value bearing material through the inlet arrangement 22 into the attrition zone 16 at a pre-determined flow rate and velocity. The solid particles in the slurry impact against each other in the attrition zone 16 at high velocity causing attritioning thereof. The value bearing material may be natural or synthetic, and will typically comprise a metalliferous ore, concentrate, matte or slag. The value bearing material may be a base metal ore, gold ore, diamond ore, platinum ore, or a slag. The desired fraction of this material is the so-called value part of the ore or the like.

Air or a similar gas is introduced into the chamber via an air supply line 24 passing through the inlet arrangement 22. The attritioned particles, which are chemically modified by the addition of suitable flotation and other chemicals to render the particles hydrophobic, are taken up by the rising gas bubbles 26 into the froth layer or phase 28. The froth phase 28 passes over the launder 30. The launder 30 is located adjacent the mouth 32 at an upper end 34 of the vessel 12. The froth exits via outlet 36 for further processing, if necessary, to recover the desired fraction. Excess slurry located in the region generally at 38 passes through a recirculation circuit 40 to the pump 20 for reintroduction into the chamber 14. In this embodiment, the desired fraction is selectively taken up into the froth phase. An alternative would be to introduce flotation chemicals arranged to take the gangue into the froth phase, selectively leaving the desired fraction or value portion in the slurry for recovery at a later stage.

Located intermediate the inlet arrangement 22 and the launder 30 is a woven wire or mesh screen 42 which selectively allows particles below a certain size to pass into the flotation zone 18. Particles in the flotation zone 18 which are not taken up into the froth phase 28 are arranged to re-circulate back to the inlet arrangement 22 via an outlet 44 and by-pass conduit 46.

The pulp phase height can be controlled by adjusting the height of the launder 30 or by varying the speed of the circulation pump 20.

Figure 2:
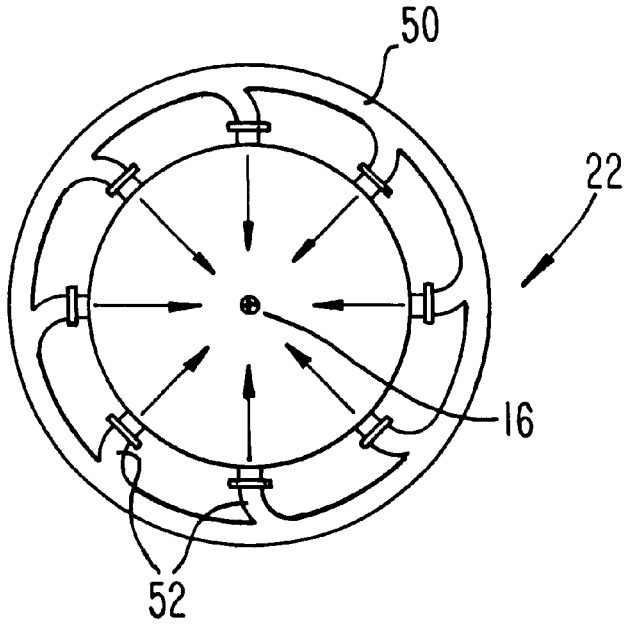
FIG. 2 is a plan view of an inlet nozzle arrangement of the apparatus of FIG. 1.

Referring to FIG. 2 of the drawings, the inlet arrangement 22 is shown in greater detail. The inlet arrangement 22 consists of a slurry feed pipe 50 which feeds material into the attrition zone 16 via multiple nozzles 52. The nozzles 52 are arranged to direct the particles towards one another at high velocity causing attritioning of the particles. This has the effect of cleaning the particles surfaces, removing any oxidised film or surface contamination that may have occurred, and also aids in particle size reduction. This contamination may have occurred due to the material that is to be concentrated being covered with gangue material during the particle size reduction phase of the recovery process.

Figure 3:
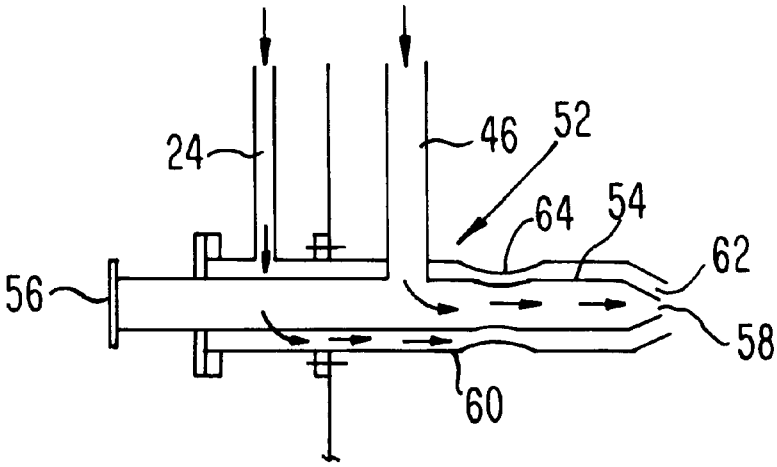
FIG. 3 is a cross sectional side view of an inlet nozzle of the apparatus of FIG. 1.

As can be seen in FIG. 3, each nozzle 52 has a slurry feed pipe 54 having an inlet 56 and an outlet 58 for transferring slurry from the pump 20 into the chamber 14 The by-pass conduit 46 is also in flow communication with the feed pipe 54 for any returning material from the flotation zone 18. Surrounding the feed pipe 54 is an air inlet pipe 60 in air communication with the air supply line 24. It has an outlet 62 adjacent the feed pipe outlet 58. A venturi 64 is located intermediate the respective inlets and outlets. As slurry is pumped through the feed pipe 54 and out of the nozzle outlet 58, a pressure zone lower than atmospheric pressure is caused at the point of induction resulting in air flow via the venturi 64. In conventional froth flotation systems, air is commonly forced into the cell via compressors or induced via a rotating impeller. The venturi 64 does away with the need for additional air induction means.

Figure 4:
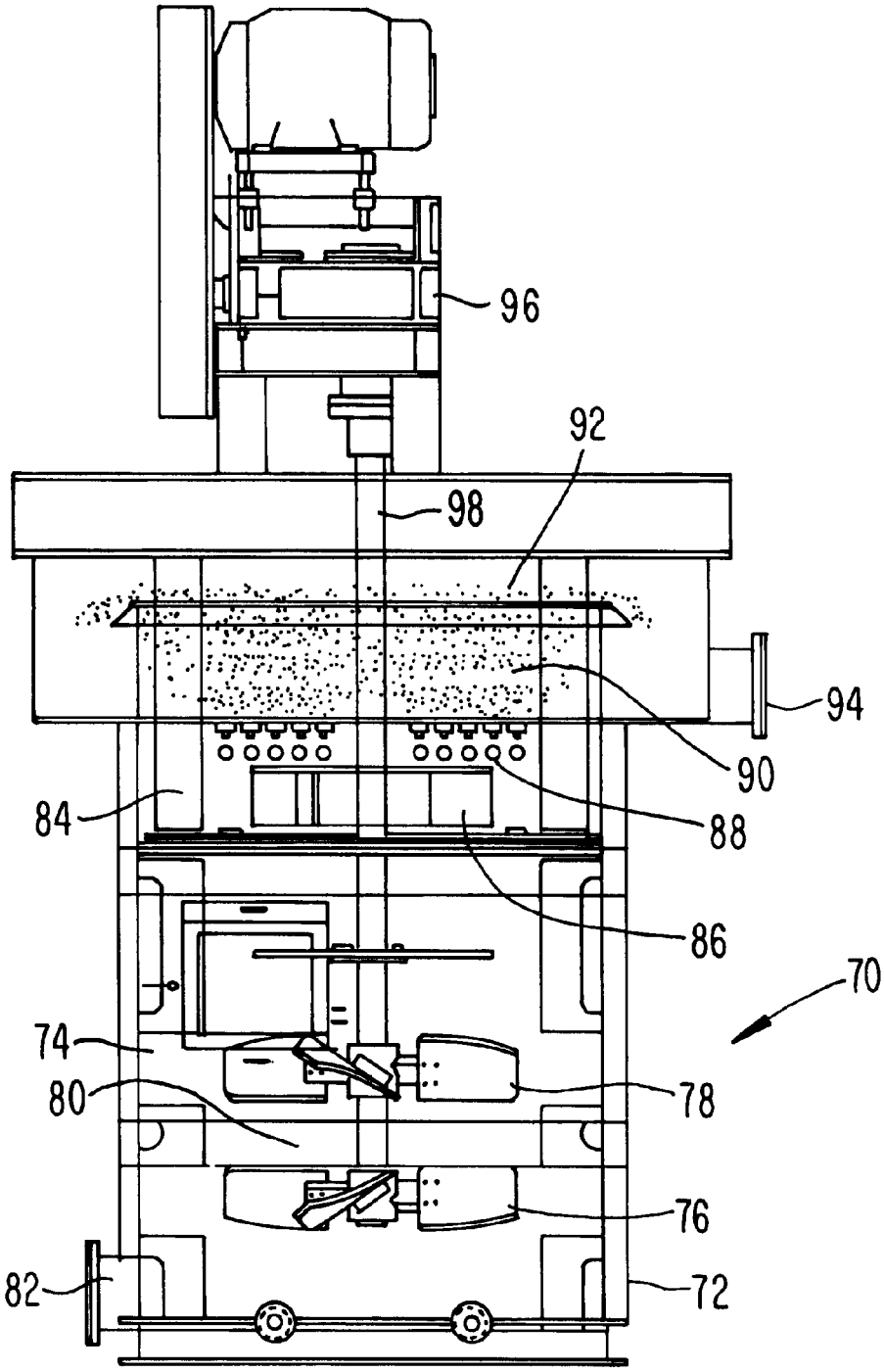
FIG. 4 is a schematic, sectional side view of a second embodiment of an apparatus of the invention.

Referring now to FIG. 4 of the drawings, there is shown a modified mechanical attrition scrubber 70. The scrubber 70 includes a vessel 72 defining a chamber 74. Located in the chamber 74 are a pair of opposed impellers 76 and 78 which define an attrition zone 80 between them. An inlet 82 is provided for introducing slurry into the chamber 74. The impellers 76 and 78 cause the particles to impact against each other under high velocity, once again causing attritioning of the particle surfaces. The attritioned particles are then caused to flow from the chamber 74 into a flotation chamber 84 located above the chamber 74 by an impeller 86. Air is introduced into the flotation chamber 84 via a compressor 88 to form gas bubbles 90 rising through the slurry. Once again, the slurry is conditioned with suitable chemicals to cause a difference in hydrophobicity/hydrophilicity between phases of value and gangue components. Once again, the desired materials are either specifically taken up by the gas bubbles into the froth phase or layer 92 or left behind in the slurry. The froth layer flows through the outlet 94, for further processing if desired.

The purpose of the impeller 86 is to create a positive head and allow the non-floatable species to be transferred to an adjacent unit without having to independently pump or have the units on descending steps to facilitate gravity flow.

The impeller 86 will also draw the slurry at a controlled and predictable rate from the attrition zone 80, thus minimising short-circuiting.

The impellers 76, 78 and 86 are driven by a conventional stirrer mechanism 96 via the shaft 98. This arrangement will not be described in any detail for the purposes of this invention.

The apparatus and process of the invention are believed to provide advantages over conventional systems. In particular, they combine the principles of attritioning and flotation in a single unit for optimising the recovery of the desired fraction. In addition, the froth launder and pulp recirculation system have been devised to allow for froth level control via weir adjustment and various control valves.

What is claimed is:

1. An apparatus for recovering a desired fraction of a raw material bearing the desired fraction, the apparatus comprising:

a vessel or cell defining a treatment chamber therein;

an inlet into the chamber for introducing a slurry of raw materials to be treated into the chamber;

an attrition zone defined in a portion of the chamber proximate the inlet in the flow path of material introduced into the chamber, the particles being caused to impact against each other in the attrition zone to cause attritioning thereof, wherein the attrition zone has an attritioner that causes the particles to contact one another under high velocity;

a flotation zone defined in a distal portion of the chamber, in flow communication with the attrition zone, in which attritioned particles from the attrition zone can be contacted with gas bubbles to form a phase separated from the slurry by a slurry-froth interface such that the desired fraction is either selectively taken up into the froth phase by the gas bubbles or selectively left behind in the slurry; and an outlet from the chamber for the froth phase, wherein the attritioner has a pair of spaced apart impellers defining the attrition zone therebetween, the impellers being arranged to force particles to collide with one another in the attrition zone.

2. An apparatus for recovering a desired fraction of a raw material bearing the desired fraction, the apparatus comprising:

a vessel or cell defining a treatment chamber therein;

an inlet into the chamber for introducing a slurry of raw materials to be treated into the chamber;

an attrition zone defined in a portion of the chamber proximate the inlet in the flow path of material introduced into the chamber, the particles being caused to impact against each other in the attrition zone to cause attritioning thereof;

a flotation zone defined in a distal portion of the chamber, in flow communication with the attrition zone, in which attritioned particles from the attrition zone can be contacted with gas bubbles to form a froth phase separated from the slurry by a slurry-froth interface such that the desired fraction is either selectively taken up into the troth phase by the gas bubbles or selectively left behind in the slurry;

an outlet from the chamber for the froth phase; and a selective component located intermediate the attrition zone and the flotation zone for selectively allowing attritioned particles to pass into the flotation zone.

3. An apparatus according to claim 2, wherein the selective component is a screen.

4. An apparatus for recovering a desired fraction of a raw material bearing the desired fraction, the apparatus comprising:

a vessel or cell defining a treatment chamber therein;

an inlet into the chamber for introducing a slurry of raw materials to be treated into the chamber;

an attrition zone defined in a portion of the chamber proximate the inlet in the flow path of material introduced into the chamber, the particles being caused to impact against each other in the attrition zone to cause attritioning thereof;

a flotation zone defined in a distal portion of the chamber, in flow communication with the attrition zone, in which attritioned particles from the attrition zone can be contacted with gas bubbles to form a froth phase separated from the slurry by a slurry-froth interface such that the desired fraction is either selectively taken up into the froth phase by the gas bubbles or selectively left behind in the slurry;

an outlet from the chamber for the froth phase; and a bypass system for returning particles which have not been taken up into the froth phase to the attrition zone for a further pass therethrough.

5. An apparatus for recovering a desired fraction of a raw material bearing the desired fraction, the apparatus comprising:

a vessel or cell defining a treatment chamber therein;

an inlet into the chamber for introducing a slurry of raw materials to be treated into the chamber;

an attrition zone defined in a portion of the chamber proximate the inlet in the flow path of material introduced into the chamber, the particles being caused to impact against each other in the attrition zone to cause attritioning thereof, wherein the attrition zone is located in a lower portion of the vessel and the flotation zone is located in an upper portion of the vessel;

a flotation zone defined in a distal portion of the chamber, in flow communication with the attrition zone, in which attritioned particles from the attrition zone can be contacted with gas bubbles to form a froth phase separated from the slurry by a slurry-froth interface such that the desired fraction is either selectively taken up into the froth phase by the gas bubbles or selectively left behind in the slurry; and an outlet from the chamber for the froth phase.

* * * * *